US011850867B2

(12) United States Patent
Palumbo

(10) Patent No.: US 11,850,867 B2
(45) Date of Patent: Dec. 26, 2023

(54) INK SUPPLY SYSTEM FOR DIGITAL PRINTING DEVICE AND DIGITAL PRINTING DEVICE COMPRISING SAID SYSTEM

(71) Applicant: NEOS S.r.l., Fiorano Modenese (IT)

(72) Inventor: Vincenzo Palumbo, Fiorano Modenese (IT)

(73) Assignee: NEOS S.R.L., Fiorano Modenese (IT)

( * ) Notice: Subject to any disclaimer, the term of this patent is extended or adjusted under 35 U.S.C. 154(b) by 112 days.

(21) Appl. No.: 17/298,402

(22) PCT Filed: Nov. 27, 2019

(86) PCT No.: PCT/EP2019/082656

§ 371 (c)(1),
(2) Date: May 28, 2021

(87) PCT Pub. No.: WO2020/109346

PCT Pub. Date: Jun. 4, 2020

(65) Prior Publication Data

US 2021/0402789 A1 Dec. 30, 2021

(30) Foreign Application Priority Data

Nov. 28, 2018 (EP) ..... 18425089

(51) Int. Cl.
*B41J 2/175* (2006.01)
*B41J 2/18* (2006.01)

(52) U.S. Cl.
CPC ..... *B41J 2/17566* (2013.01); *B41J 2/17596* (2013.01); *B41J 2/18* (2013.01)

(58) Field of Classification Search
CPC . B41J 2/175; B41J 2/18; B41J 2/17596; B41J 2/195; B41J 2/17566
See application file for complete search history.

(56) References Cited

U.S. PATENT DOCUMENTS 8,132,902 B2 * 3/2012 Shibata ..... B41J 2/17509 347/89
8,141,973 B2 * 3/2012 Hamazaki ..... B41J 2/17509 347/89

(Continued)

FOREIGN PATENT DOCUMENTS

CN 204547353 U 8/2015
CN 106827821 A 6/2017

OTHER PUBLICATIONS

Written Opinion of the International Searching Authority issued in connection with PCT/EP2019/082656.

(Continued)

*Primary Examiner* — An H Do
(74) *Attorney, Agent, or Firm* — Akerman LLP

(57) ABSTRACT

Ink supply system (1) for digital printing device comprising: a supply tank (9) suitable for containing ink; a delivery tank (2), in fluid connection with said supply tank (9), suitable for containing ink; one or more delivery conduits (4) suitable for connecting said delivery tank (2) to one or more print heads (100) associatable with said supply system (1); first pressure adjusting means (10) suitable for controlling the pressure inside the delivery tank (2); a supply pump (6) suitable for moving ink from said supply tank (9) to said delivery tank (2); a first level sensor (7) suitable for performing the continuous reading of the level variations inside the delivery tank (2); wherein said supply pump (6) is continuously feed-back controlled on the basis of the reading of said first level sensor (7) for keeping a pre-defined level inside said delivery tank (2).

11 Claims, 3 Drawing Sheets

(56) References Cited

U.S. PATENT DOCUMENTS

| | | | | |
|---|---|---|---|---|
| 8,210,666 | B2 * | 7/2012 | Hirashima | B41J 2/17596 347/85 |
| 8,408,685 | B2 | 4/2013 | Delueg | |
| 8,974,046 | B2 * | 3/2015 | Ooishi | B41J 2/17596 347/85 |
| 2008/0273063 | A1 | 11/2008 | Wouters et al. | |
| 2013/0208038 | A1 | 8/2013 | Isozaki et al. | |
| 2018/0134033 | A1 | 5/2018 | Sawase | |
| 2018/0257384 | A1 | 9/2018 | Hara | |

OTHER PUBLICATIONS

International Search Report issued in connection with PCT/EP2019/082656.

* cited by examiner

INK SUPPLY SYSTEM FOR DIGITAL PRINTING DEVICE AND DIGITAL PRINTING DEVICE COMPRISING SAID SYSTEM

CROSS-REFERENCE TO RELATED APPLICATIONS

This application is a national phase of PCT/EP2019/082656, filed Nov. 27, 2019, and claims priority to EP18425089.2, filed Nov. 28, 2018, the entire contents of both of which are hereby incorporated by reference.

TECHNICAL FIELD

The present invention relates to an ink supply system for digital printing device and also to a digital printing device comprising said system.

It is noted that in the present description and in the annexed claims the term ink is generically intended as fluid used in printing operations, comprising also materials for specific decorations or surfaces, such as ceramic glazes, glues, lacquers, adhesion promoters (known in the sector as primers).

The invention can, in particular, find useful application in multiple technological sectors where industrial printing on surfaces of various types is required, for example in printing on paper, corrugated board, cardboard, plastic film, thermoplastic sheets; namely in the printing of labels, packaging, signs, or also ceramic coatings, glass materials, wood or metal supports.

BACKGROUND ART

In ink jet printing devices an ink supply system with one or more print heads is provided for. Such system is generally integrated in the printing device itself, usually in a portion above the print heads it supplies.

The supply system necessarily provides for a delivery conduit arranged to conduct ink from a delivery tank to the delivery nozzles of the print heads.

In more recent and sophisticated industrial printing applications, a return conduit is also provided for that conducts ink from the head to a return tank. In these cases, the supply is not defined by a simple circuit open on the delivery nozzles, but, on the contrary, by a closed circuit within which ink is made to re-circulate, defining a constant flow through the print head. The delivery nozzles open on said conduit, and part of the ink flow is deposited on the printing support on the basis of the printing commands given.

In general, the pressure of at least one of the two tanks is controlled, so as to keep a pressure differential that keeps a desired ink flow from the delivery tank to the return one.

The systems produced to date, even if substantially corresponding to the current needs of the sector, however present limits and inconveniences that are still unsolved.

The main one of such inconveniences regards the control of the pressure of the quantity of ink sent to the delivery nozzles. The current control systems are in fact characterized by abrupt pressure variations. The discontinuity of pressure at nozzle level results in local printing flaws: the pressure peaks determine an excessive delivery, namely thickened lines, while the pressure falls can make the nozzle suck air, causing white lines.

A second inconveniency of the supply systems according to the background art lies in the impossibility or anyway in the relative difficulty to invert the ink flow between delivery conduit and return conduit. In the cases in which it is feasible, the operation in fact requires the realization of a local mechanical adjustment, and cannot be executed automatically.

On the other hand, said flow inversion can prove to be necessary in certain situations, for example in the phase of first connection of the head to completely wet the inner conduits of the same, eliminating every air residue inside them.

A further inconveniency of the supply systems according to the background art derives from the fact that the flowrate of the re-circulated ink and the meniscus pressure in the heads cannot be controlled independently. Such constraint limits the functioning range of the heads, and can even completely preclude the use of certain heads where the flowrate and meniscus pressure values required by them do not fall within the circuit range.

Supply systems according to the prior art are disclosed, for instance, in documents EP 3 372 411 A1 and CN 106 827 821 A.

The technical problem at the basis of the present invention is therefore that of solving the inconveniences encountered in the ink supply systems known to date, in particular improving the printing performances and the flexibility of use of the printing devices the system is applied to.

DISCLOSURE OF INVENTION

The technical problem previously identified is solved by an ink supply system for digital printing device comprising:

- a supply tank suitable for containing ink;
- a delivery tank suitable for containing ink, in fluid connection with said supply tank;
- one or more delivery conduits suitable for connecting said delivery tank to one or more print heads associatable with said supply system;
- first pressure adjusting means suitable for controlling the pressure inside the delivery tank;
- a supply pump suitable for moving ink from said supply tank to said delivery tank;
- a first level sensor suitable for continuously acquiring a level signal of the ink inside the delivery tank;
- wherein said supply pump is continuously feed-back controlled on the basis of the level signal acquired by the first level sensor for keeping a pre-defined level inside said delivery tank.

In the supply system outlined above, the ink delivery tank is constantly kept at a pre-defined filling value; on the contrary, in the systems according to the background art it is filled up when an inferior level threshold is reached.

The Applicant has in fact noted that, by keeping a continuous control of the level and therefore avoiding sensitive variations of the same, pressure changes are eliminated or at least significantly reduced inside the chamber, ultimately obtaining a higher printing quality.

The variations of level inside the chamber, allowed by the systems according to the background art, in fact promote variations of pressure that the pressure control means of the background art cannot compensate instantaneously, causing the local printing flaws described in the prologue of the present application.

To realize the continuous level control described above, the first level sensor is a level sensor of the analog type, unlike the level sensors currently employed in the realizations of the background art, which are digital.

The feed-back control of the supply pump on the basis of the reading of said first level sensor can comprise at least a proportional action, and is preferably executed with a PID controller.

A proportional control action, as known from control theory, is a correction which is proportional to the difference between the desired value and the measured value of the controlled variable. A feed-back control comprising at least a proportional action applies a correction based at least on a proportional term (usually denoted with P).

The supply system according to the invention can be a single-direction supply system, or it can be a re-circulating ink supply system.

In the second case, the supply system will further comprise:

- a return tank suitable for containing ink, in connection with the supply tank;
- one or more return conduits suitable for connecting the one or more print heads to said return tank, the delivery conduits and the return conduits defining an ink path through said one or more print heads;
- second pressure adjusting means suitable for controlling the pressure inside the return tank;
- a re-circulating pump suitable for moving ink from said return tank to said supply tank;
- a second level sensor suitable for continuously acquiring a level signal of the ink inside the return tank;
- wherein said re-circulating pump is continuously feed-back controlled on the basis of the level signal acquired by the second level sensor for keeping a pre-defined level inside said return tank.

For the control of the level in the return tank the devices already described can also be adopted with reference to the control of the level in the delivery tank. In particular:

- the second level sensor is preferably an analog sensor;
- the feed-back control of the re-circulating pump on the basis of the signal acquired by said second level sensor preferably comprise at least a proportional action;
- said feed-back control is preferably realized by a PID controller.

In the case of ink re-circulating supply system, the first pressure adjusting means and the second pressure adjusting means preferably allow an independent control of the pressure inside the delivery tank and inside the return tank.

By controlling the two variables separately, it is possible to select without constraints the ink delivery value through the heads and the meniscus pressure value, since, as known, the first parameter depends on the difference between the pressures of the delivery and return tanks, while the second parameter depends on the average value of the pressures. A wide adjustment range of the heads applied is thus obtained.

Preferably, both the first pressure adjusting means and the second pressure adjusting means are capable of taking the pressure in the respective pressurized tanks both to values inferior to the atmospheric pressure and to values superior to the atmospheric pressure, namely the two chambers can be taken both to positive pressure and to depression.

Such device allows to automatically obtain an inverse flow inside the head—operation that is useful to wet the inner conduits of the head at the first start to eliminate every air residue—taking the pressure of the return tank to a higher value with respect to the pressure of the delivery tank.

The possibility, unknown in the sector, of taking the return tank to positive pressure values (namely superior to the atmospheric pressure) allows also to automatically execute purge operations, applying positive pressure to both tanks.

The pressure control means—first or second—can comprise a compressor and an inversion valve, wherein the compressor's action defines a compression of a gaseous phase within the delivery tank and/or return tank when the inversion valve is in a first configuration, an expansion of said gaseous phase when the inversion valve is in a second configuration.

These alternative configurations allow, as suggested above, to realize a positive or negative pressure, operating the inversion valve so that the compressor promotes the circulation of air in the desired direction—incoming or outcoming with respect to the pressurized chamber.

The pressure control means preferably comprise a pressure control line with an initial section communicating with the delivery tank and/or return tank, a final section communicating with an outlet to the atmosphere, and a ring-shaped intermediate section intercepted by said compressor and provided with an inlet and an outlet, wherein the inversion valve connects the inlet and the outlet of the intermediate section respectively to the final section and to the initial section of the pressure control line if in first configuration, and vice versa if in second configuration.

The initial section of the pressure control line preferably comprises an expansion tank on which a pressure sensor is provided for, the signal detected by said pressure sensor being employed for the feed-back control of the pressure.

Alternatively, the pressure control means can comprise a proportional valve connected to a compressed air circuit, in particular to a high pressure channel and to a vacuum channel.

The first and the second pressure control means are preferably of the same type.

The technical problem outlined above is further solved by a digital printing device comprising an ink supply system of the type described above.

Further features and advantages will become more apparent from the detailed description made below of two preferred non-limiting embodiments of the present invention, with reference to the annexed drawings, given for illustrating but not limiting purposes.

MODES FOR CARRYING OUT THE INVENTION

Figure 1:
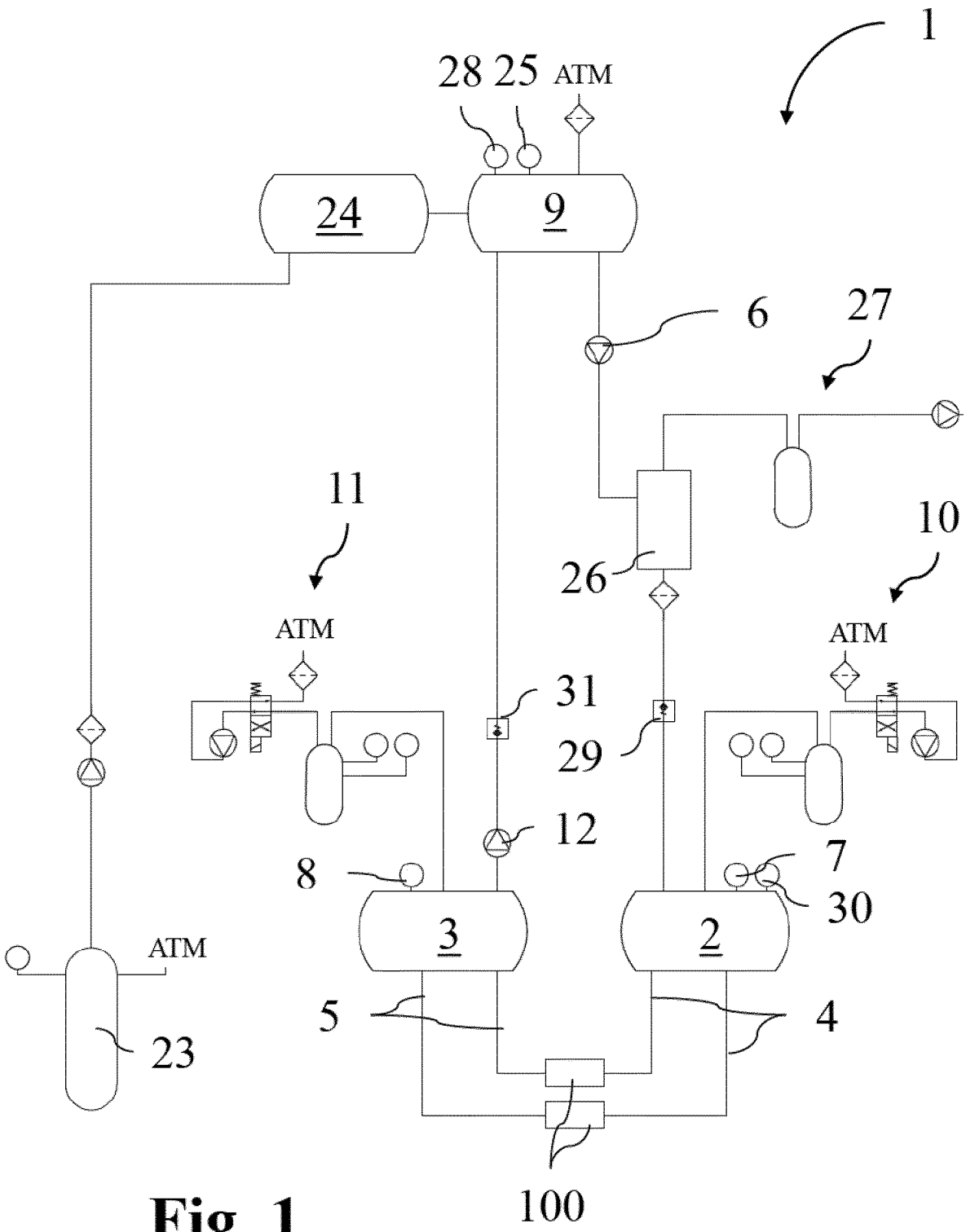
FIG. 1 shows a scheme of an ink supply system according to a first embodiment of the present invention.

With reference to the annexed FIG. 1, we generically identify with 1 an ink supply system for digital printing device according with a first embodiment of the present invention.

We note that such a supply system 1 is generally integrated in a digital printing device, namely in a device arranged for the digital printing of a printing support.

Such printing device, known per se, preferably comprises a fixed bridge under which the printing support is dragged, which can be of various nature. One or more print heads 100, supplied by the supply device 1, provide for the delivery of ink on the printing support that transits under the bridge, realizing an image, a motif, a decoration, or any desired graphic element.

Alternatively, the device can comprise a mobile print module that transits over a fixed printing support (for example: plotter).

The supply device 1, of the ink recirculating type, comprises a delivery tank 2 and a return tank 3 provided with one or more delivery conduits 4 and return conduits 5 that close themselves on the print heads 100, realizing the desired ink circulation.

Ink comes from a supply tank 9 above, which in turn is connected to a main tank 23 with interposition of a conditioning chamber 24. Ink coming from the main tank 23 is preliminarily heated in said conditioning chamber 24 to be taken to a homogeneous temperature with ink circulating in the circuit of the supply device 1.

A level sensor 25 of the supply tank 9 indicates the emptying of such volume, enabling the recall of more ink from the main tank 23.

On the supply tank 9 are also provided for, on the one hand, an ink conditioning system, which allows both the heating and the cooling thereof, and on the other hand, a temperature sensor 28, which allows the control of such variable of the fluid.

The presence of a conditioning system with refrigerating means as well as heating means appears to be particularly advantageous within the context of the invention, since it allows to cancel the heating effects of ink due to the circulation in the heads.

The supply tank 9 is connected to the delivery tank 2 through a line intercepted by a supply pump 6, which encourages the movement of ink from said supply tank 9 to said delivery tank 2.

Said line is also interrupted by an intermediate degassing device 26, from which an evacuation line 27 of the excess air departs.

A line is also provided for that takes ink from the return tank 3 to the supply tank 9, on which a recirculating pump 12 works. Such line is intercepted by a non-return valve 29, which impedes the passage of ink when the circuit is closed.

In use, ink is therefore re-circulated through the circuit described above: from the supply tank 9 to the delivery tank 2, through the delivery conduits 4 to the heads 100, through the return conduits 5 to the return tank 3 and from here again to the supply tank 9.

Also the line that connects the return tank 9 to the supply tank 9 is intercepted by a non-return valve 31, which impedes the passage of ink when the circuit is idle.

The delivery tank 2 provides for a conditioning system of the ink that allows the heating thereof and a temperature sensor 30 for the control of such variable.

The delivery tank 2 and the return tank 3 are provided with a first level sensor 7 and a second level sensor 8 respectively, of analog type, destined to perform the continuous reading of the variations of the level of ink inside the chambers.

Both the first level sensor 7 and the second level sensor 8 send the level signal acquired to a controller, preferably of PID type, which operates the supply pump 6 and the re-circulating pump 12 respectively for keeping a level setpoint inside the delivery tank 2 and the return tank 3.

The setpoint is preferably represented by a constant ink level, and the use of the continuous feed-back control allows to avoid sensitive variations in time, unlike what happens in the realizations of the background art, wherein the filling up and the emptying of the tanks is executed only when the minimum and the maximum thresholds are reached.

The delivery tank 2 and the return tank 3 are both pressurized, and are provided for respective first adjusting means 10 and second adjusting means 11, independent from one another.

The first and the second adjusting means 10, 11 are of the same type.

Figure 3:
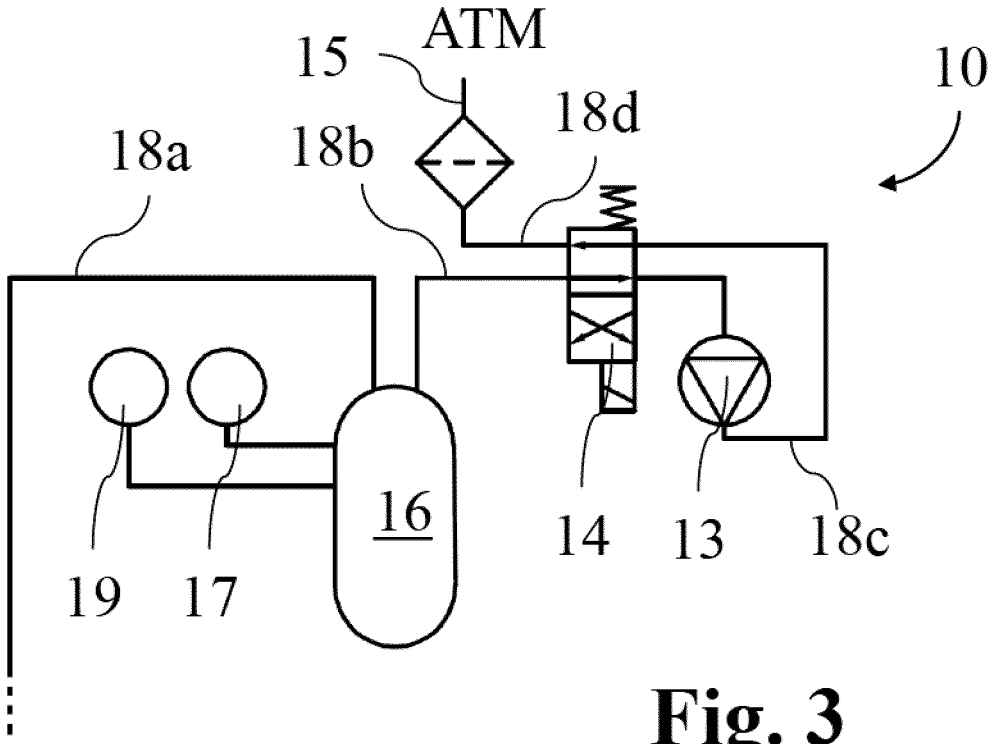
FIG. 3 shows an enlargened detail of the scheme of FIG. 1, relative to the pressure adjusting means.

With reference to FIG. 3, the following are described here: first adjusting means 10 acting on the delivery tank 2; the same description applies, mutatis mutandis, also to the second adjusting means 11 acting on the return tank 3.

The adjusting means 10, 11 comprise an expansion tank 16, directly connected to the upper part of the respective delivery tank 2 or return tank 3 through a first portion 18*a* of a pressure control line.

At the expansion tank 16 a pressure sensor 17 is provided for, which allows to acquire a signal indicative of the pressure inside the expansion tank 16, substantially equal to the pressure within the delivery tank 2 or return tank 3 directly connected to it.

On the expansion tank 16 an overflow sensor 19 is also provided for, suitable for identifying a maximum allowable liquid threshold inside the volume.

From the upper part of the expansion tank 16 a second portion 18*b*, 18*c*, 18*d* branches off of the pressure control line; thanks to the control executed by the overflow sensor 19 the absence of liquid in such line portion is guaranteed.

The second portion comprises an initial section 18*b*, a ring-shaped intermediate section 18*c*, and a final section 18*d* that flows into an outlet to the atmosphere 15. On the intermediate section 18*c* a compressor 13 acts, while an inversion valve 14, specifically a two-position electrovalve, allows to invert the connections between the two outlets of the intermediate section 18*c* and the initial section 18*b* and final section 18*d*.

When the inversion valve 14 is in a first configuration, the connection of the intermediate section 18*c* with the initial section 18*b* and final section 18*d* is such that the action of the compressor 13 takes air from the outlet to the atmosphere 15 to the expansion tank 16. In this case, the gas present in the expansion tank 16 compresses and the pressure measured by the pressure sensor 17 increases.

When the inversion valve 14 is in a second configuration (represented in FIG. 3), the connection of the pressure control line is inverted and the compressor 13 acts as an air expulsion fan, defining a gas expansion and a pressure fall in the expansion tank 16.

It is noted that, thanks to the action of the compressor 13 and of the inversion valve 14, the respective pressurized tank 2, 3 can be taken both to pressure and to depression.

The adjusting means 10 preferably act with feed-back control on the variable of pressure measured by the pressure sensor 17, following a pressure setpoint set by the operator.

Figure 2:
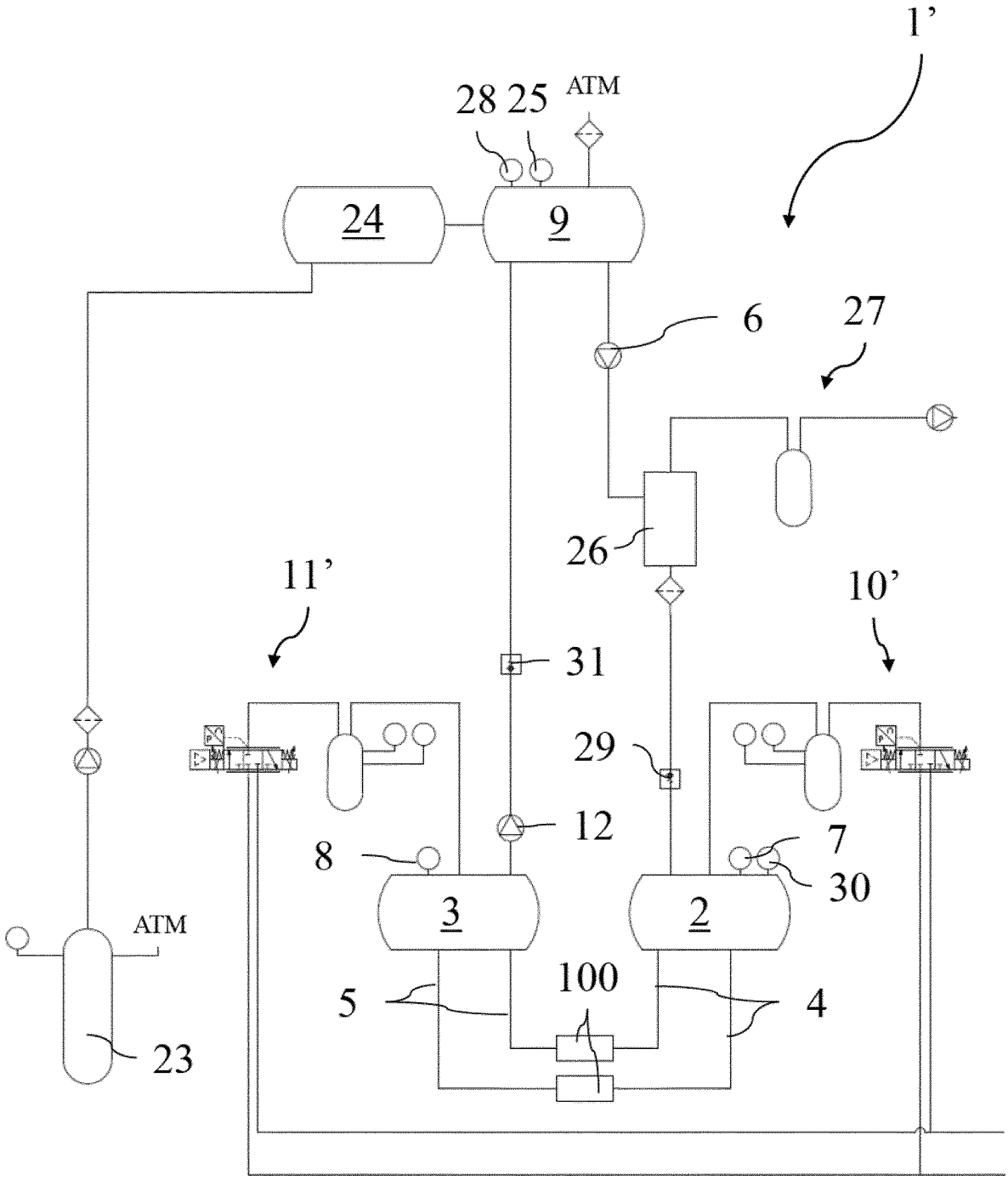
FIG. 2 shows a scheme of an ink supply system according to a second embodiment of the present invention.

With reference to FIG. 2, an ink supply system for digital printing device according to a second embodiment of the present invention is generically identified with reference 1'.

It is noted that the second embodiment differs from the preceding one only in the realization of the first and of the second pressure control means 10', 11'.

For the other components of the device, integral reference is therefore made to the previous description.

The first adjusting means 10' and second adjusting means 11', as in the case of the first embodiment, are independent one from another and are of the same type.

Figure 4:
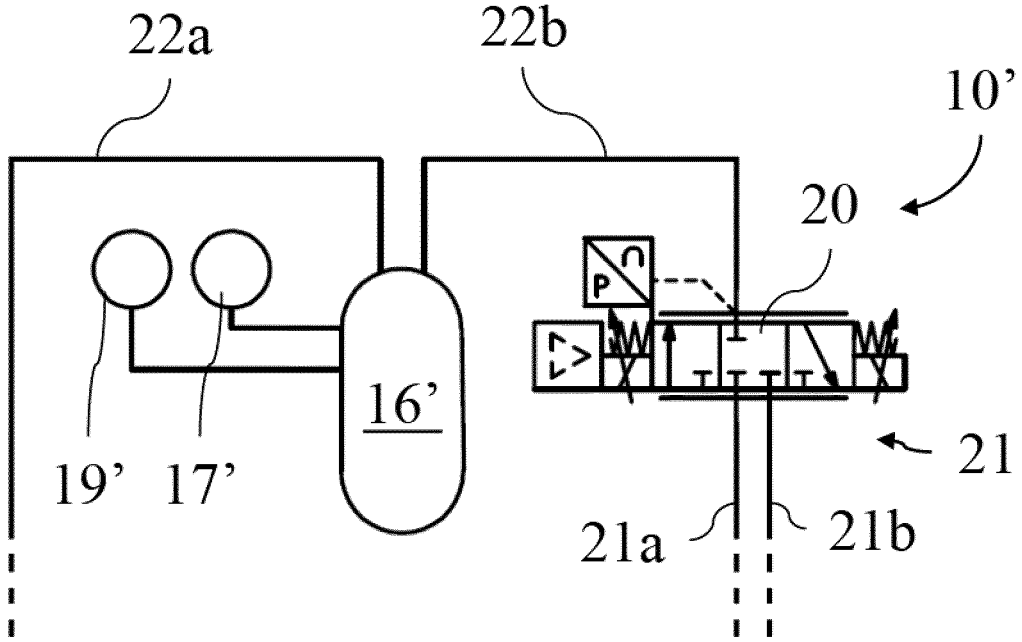
FIG. 4 shows an enlargened detail of the scheme of FIG. 2, relative to the pressure adjusting means.

With reference to FIG. 4, below are described the first adjusting means 10' acting on the delivery tank 2; the same description applies, mutatis mutandis, also to the second adjusting means 11' acting on the return tank 3.

The adjusting means 10', 11' comprise also in this case an expansion tank 16', directly connected to the upper part of the respective delivery tank 2 or return tank 3 through a first portion 22*a* of a pressure control line.

At the expansion tank 16' a pressure sensor 17' is provided for, which allows to acquire a signal indicative of the pressure inside the expansion tank 16', substantially equal to the pressure within the delivery tank 2 or return tank 3 directly connected to it.

On the expansion tank 16' an overflow tank 19' is also provided for, suitable for identifying a maximum allowable liquid threshold inside the volume.

From the upper part of the expansion tank 16 a second portion 18*b*, 18*c*, 18*d* branches off of the pressure control line; thanks to the control executed by the overflow sensor 19 the absence of liquid in such line portion is guaranteed.

The second portion 22*b* connects the expansion tank 16' with a proportional valve 20, connected to a compressed air circuit 21 provided with a vacuum branch 21*a* and with a high pressure branch 21*a*.

It is noted that the compressed air circuit 21 is preferably shared between the first adjusting means 10' and the second adjusting means 11'.

Thanks to the proportional valve 20, it is possible to modify the pressure in the expansion tank 16' and in the respective delivery tank 2/return tank 3, modifying the reading of the pressure sensor 17'.

Also in this embodiment, the delivery tank 2/return tank 3 can be taken both to positive pressures and to negative pressures.

The adjusting means 10' preferably act with feed-back control on the variable of pressure measured by the pressure sensor 17', following a pressure setpoint set by the operator.

The systems described above, thanks to the double feed-back control on the pressure and on the level, allow an unusual stability of the pressure values in the delivery tank 2 and return tank 3, avoiding or anyway minimizing the printing errors due to changes in the ink pressure.

The systems described above also allow a wide range of adjustments for the ink flowrate and for the meniscus pressure in the heads 100, being possible to independently adjust the incoming Pin pressure and the outcoming Pout pressure, defined by the pressure in the delivery chamber 2 and in the return chamber 3 respectively.

Further, always thanks to the above-mentioned adjustment faculty, it is possible to execute a flow inversion (reverse flow), or else a purge operation of the heads 100 automatically.

Naturally, to the description made here, in order to satisfy contingent and specific needs, a skilled person will be able to devise further modifications and variants, all however contained in the scope of protection of the invention as defined by the following claims.

What is claimed is:

1. An ink supply system for digital printing device comprising:

a supply tank suitable for containing ink;

a delivery tank suitable for containing ink, in fluid connection with said supply tank;

one or more delivery conduits suitable for connecting said delivery tank to one or more print heads associable with said supply system;

first pressure adjusting means suitable for controlling the pressure inside the delivery tank;

a supply pump suitable for moving ink from said supply tank to said delivery tank;

a first level sensor suitable for continuously acquiring a level signal of the ink inside the delivery tank;

a return tank, suitable for containing ink, in connection with the supply tank;

one or more return conduits, suitable for connecting the one or more print heads to said return tank, the delivery conduits and the return conduits defining an ink path through said one or more print heads;

second pressure adjusting means, suitable for controlling the pressure inside the return tank;

a re-circulating pump, suitable for moving ink from said return tank to said supply tank;

a second level sensor, suitable for continuously acquiring a level signal of the ink inside the return tank;

wherein said supply pump is continuously feed-back controlled on the basis of the level signal acquired by the first level sensor for keeping a pre-defined level inside said delivery tank;

wherein said first level sensor is an analog sensor; and wherein said re-circulating pump is continuously feed-back controlled on the basis of the level signal acquired by the second level sensor for keeping a pre-defined level inside said return tank.

2. Supply system according to claim 1, wherein the feed-back control of said supply pump on the basis of the signal acquired by said first level sensor comprises at least a proportional action.

3. Supply system according to claim 1, wherein both the first and the second level sensor are analog sensors.

4. Supply system according to claim 1, wherein both the feed-back control of said supply pump on the basis of the signal of said first level sensor and the feed-back control of said re circulating pump on the basis of the signal of said second level sensor comprise at least a proportional action.

5. Supply system according to claim 4, further comprising two PID controllers for the feed-back control of the supply pump and of the re-circulating pump.

6. Supply system according to claim 1, wherein said first pressure adjusting means and said second pressure adjusting means allow the independent control of the pressure inside the delivery tank and inside the return tank.

7. Supply system according to claim 6, wherein both the first pressure adjusting means and the second pressure adjusting means are suitable for taking the pressure inside the delivery tank and inside the return tank respectively both to values inferior to the atmospheric pressure and to values superior to the atmospheric pressure.

8. Supply system according to claim 7, wherein said first and/or second pressure control means comprise a compressor and an inversion valve, wherein the compressor's action defines a compression of a gaseous phase within the delivery tank and/or return tank when the inversion valve is in a first configuration, an expansion of said gaseous phase when the inversion valve is in a second configuration.

9. Supply system according to claim 8, wherein said first and/or second pressure control means further comprise a pressure control line with an initial section communicating with the delivery tank and/or return tank, a final section communicating with an outlet to the atmosphere, and a ring-shaped intermediate section intercepted by said compressor and provided with an inlet and an outlet, wherein the inversion valve respectively connects the inlet and the outlet of the intermediate section to the final section and to the initial section of the pressure control line if in first configuration, and vice versa if in second configuration.

10. Supply system according to claim 9, wherein the initial section of the pressure control line comprises an expansion tank on which a pressure sensor is provided for, the signal detected by said pressure sensor being employed for the feed-back control of the pressure.

11. Supply system according to claim 7, wherein said first and/or said second pressure control means comprise a proportional valve connected to a compressed air circuit.

* * * * *